US007448630B1

(12) United States Patent
Lam et al.

(10) Patent No.: US 7,448,630 B1
(45) Date of Patent: Nov. 11, 2008

(54) POKER CARD GAME

(76) Inventors: Hung T. Lam, 13072 Hitchcock La., Garden Grove, CA (US) 92843; Linh N. Vay, 13072 Hitchcock La., Garden Grove, CA (US) 92843

( * ) Notice: Subject to any disclaimer, the term of this patent is extended or adjusted under 35 U.S.C. 154(b) by 0 days.

(21) Appl. No.: 10/321,221

(22) Filed: Dec. 16, 2002

(51) Int. Cl.
*A63F 1/00* (2006.01)

(52) U.S. Cl. ..... 273/292; 273/274; 463/13

(58) Field of Classification Search ..... 273/292, 273/274, 309; 463/12, 13
See application file for complete search history.

(56) References Cited

U.S. PATENT DOCUMENTS

| | | | | |
|---|---|---|---|---|
| 5,489,101 | A * | 2/1996 | Moody | 273/292 |
| 6,102,402 | A * | 8/2000 | Scott et al. | 273/292 |
| 6,311,979 | B1 * | 11/2001 | Andrews | 273/292 |
| 6,332,614 | B1 * | 12/2001 | Hesse | 273/292 |
| 6,461,240 | B1 * | 10/2002 | Perkins | 463/13 |
| 2003/0178774 | A1 * | 9/2003 | Marcilio | 273/292 |

OTHER PUBLICATIONS

"Possible Poker Hands In An Italian 40-Card Pack", "Possible Poker Hands In A French 32-Card Pack", Scarne's Encyclopedia Of Games by John Scarne, Harper & Row Publishers, pp. 50-52, 1973.*
"Poker Strategy Using The Bug", Poker Strategy by Nesmith C. Ankeny, Basic Books, Inc., pp. 166-168, 1986.*
"32-Card Deck Poker", QA—Poker Probabilities, http://archive.org/web/20010208205104/http://www.pvv.org/~nssa/poker.html, pp. 1-20.*

* cited by examiner

*Primary Examiner*—Benjamin H Layno
(74) *Attorney, Agent, or Firm*—Blakely, Sokoloff, Taylor & Zafman

(57) ABSTRACT

An embodiment of the invention is a technique to play a card game. P pocket cards are dealt to each of a plurality of players from a deck of cards having N ranks and four suits. N is different than 13. The P pocket cards are used by the each of the players to form a five-card poker hand having a ranking. A first betting round is made among the plurality of players. The first betting round contributes to a pot. F flop cards are dealt to be seen by the plurality of players. The F flop cards are communal to the players. A second betting round is made among the players. The second betting round contributes to the pot.

23 Claims, 9 Drawing Sheets

| | | | | | | PROBABILITY |
|---|---|---|---|---|---|---|
| ROYAL FLUSH | 10♥ | J♥ | Q♥ | K♥ | A♥ | 0.000006 |
| STRAIGHT FLUSH | 7♦ | 8♦ | 9♦ | 10♦ | J♦ | 0.000036 |
| FOUR OF A KIND | 7♥ | 7♦ | A♣ | 7♠ | 7♣ | 0.000547 |
| FLUSH | 6♣ | A♣ | K♣ | J♣ | 8♣ | 0.001489 |
| FULL HOUSE | K♠ | 9♣ | 9♠ | K♦ | 9♥ | 0.003282 |
| STRAIGHT | A♥ | 5♣ | 6♦ | 7♠ | 8♣ | 0.010850 |
| 3 OF A KIND | J♦ | 5♥ | J♥ | J♣ | 6♦ | 0.035014 |
| TWO PAIR | 10♥ | J♣ | J♦ | K♣ | 10♣ | 0.078783 |
| ONE PAIR | J♣ | A♥ | 6♣ | 6♦ | 9♥ | 0.490206 |
| HIGH CARD | 9♦ | 7♦ | 10♥ | 5♣ | Q♥ | 0.052704 |

FIG. 6

POKER CARD GAME

BACKGROUND

1. Field of the Invention

Embodiments of the invention relates to the field of casino games, and more specifically, to card games.

2. Description of Related Art

Among casino card games, poker games are popular because they are not merely a game of chance, but require skills and experience. Texas Hold 'Em is a variation of the straight poker game that can be played by as many as ten players.

In Texas Hold 'Em, a complete card deck of 52 playing cards are used. Each player is dealt two cards facing down, referred to as hole or pocket cards. There are betting rounds each time the dealer shows additional cards facing up. These cards are communal cards that any player can use in combination with their two pocket cards to form a five card poker hand. The players can check, raise, or fold in each of the betting round. In the end, who has the highest hand based on an established ranking will win.

Although it is a game requiring skills and experience, like most other card games, Texas Hold 'Em depends on probabilities of poker hands for excitement and action. Betting strategies can be developed based on the chance a player can form a poker hand as high as possible using their pocket cards and communal cards. When the chance to form a good poker hand is low, players tend to give up the game early, resulting in poor table action and low payoff.

SUMMARY OF THE INVENTION

An embodiment of the invention is a technique to play a card game. P pocket cards are dealt to each of a plurality of players from a deck of cards having N ranks and four suits. N is different than 13. The P pocket cards are used by the each of the players to form a five-card poker hand having a ranking. A first betting round is made among the plurality of players. The first betting round contributes to a pot. F flop cards are dealt to be seen by the plurality of players. The F flop cards are communal to the players. A second betting round is made among the players. The second betting round contributes to the pot.

BRIEF DESCRIPTION OF THE DRAWINGS

The invention may best be understood by referring to the following description and accompanying drawings that are used to illustrate embodiments of the invention. In the drawings:

FIG. 6 is a diagram illustrating an order of ranking of the poker hands according to one embodiment of the invention.

DESCRIPTION

An embodiment of the invention is a technique to play a card game. P pocket cards are dealt to each of a plurality of players from a deck of cards having N ranks and four suits. N is different than 13. The P pocket cards are used by the each of the players to form a five-card poker hand having a ranking. A first betting round is made among the plurality of players. The first betting round contributes to a pot. F flop cards are dealt to be seen by the plurality of players. The F flop cards are communal to the players. A second betting round is made among the players. The second betting round contributes to the pot.

In the following description, numerous specific details are set forth. However, it is understood that embodiments of the invention may be practiced without these specific details. In other instances, well-known circuits, structures, and techniques have not been shown in order not to obscure the understanding of this description.

Figure 1A:
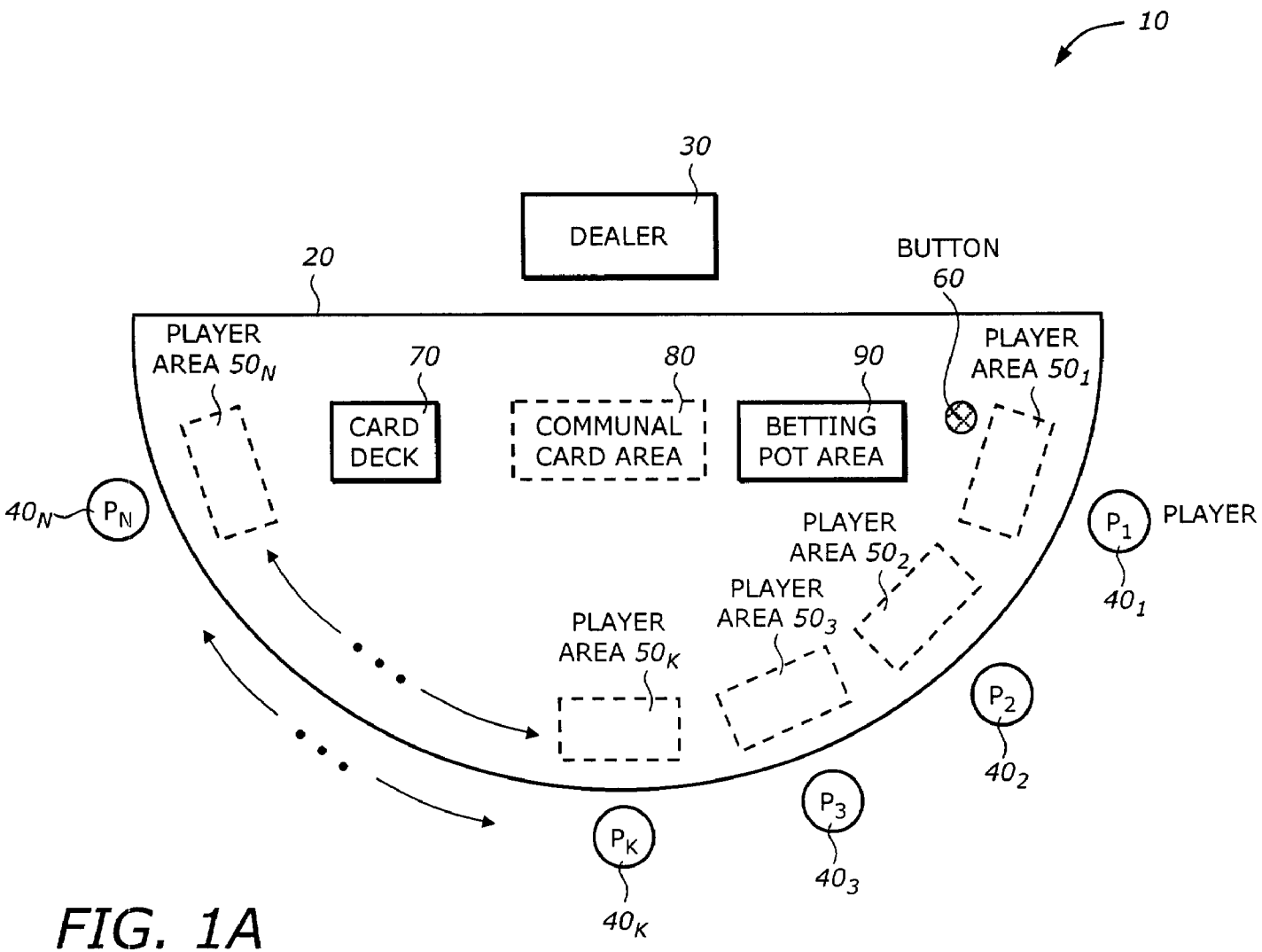
FIG. 1A is a diagram illustrating a system in which one embodiment of the invention can be practiced.

FIG. 1A is a diagram illustrating a system 10 in which one embodiment of the invention can be practiced. The system 10 includes a game table 20, a dealer 30, N players $\mathbf{40}_1$ to $\mathbf{40}_N$, a button 60, and a card deck 70. Note that the system 10 may contain more or less components as shown.

The poker game described in this invention may be referred to as California Hold 'Em, California Action Hold 'Em, Action Hold 'Em, Super Hold 'Em, Super Action Hold 'Em, California Super Action Hold 'Em or any combination thereof. Any one of these names may be used because the card game in the invention provides high action and excitement to players.

The game table 20 provides a play area to the players. The game table 20 may be a typical casino game table in a card game area, a table around a refreshment counter, or a virtual game table in a video game machine. The game table 20 includes player areas $\mathbf{50}_1$ to $\mathbf{50}_N$, a communal card area 80, and a betting pot are 90. The player areas $\mathbf{50}_1$ to $\mathbf{50}_N$ provides space for the players to place or hold the cards, chips, money, tokens, or to house video displays. When the video displays are used, the play areas $\mathbf{50}_1$ to $\mathbf{50}_N$ may also include mechanisms to allow players to place bet, select betting option, etc. The mechanisms may include user interfaces such as touch screen, keyboard, etc. The communal card area 80 provides space for communal or community cards. The communal cards are those cards that are shared or common to all active players in forming a five-card poker hand. The betting pot area 90 provides space to gather or display the bets placed by the players.

The dealer 30 deals the cards from the card deck 70. The dealer 30 may be a person working in a casino or a processor system in a computer-controlled system or a video poker game system, or a processor in a server for an on-line poker game. The dealer 30 is responsible to deal cards, to administer the game, to ensure players follow the gaming rules, to collect bets, to count money, to organize chips or tokens, to make changes, to collect discarded cards, and to perform other tasks as necessary.

The players $\mathbf{40}_1$ to $\mathbf{40}_N$ participate in the game. The objective of the game is to place bet according to same betting strategy based on an expected winning poker hand. In the end, one or more of the players is declared to be a winner or winners. The winner or winners of the game collect the money, chips, or tokens at the betting pot area. When more than one player are declared, the total amount in the betting pot area 90 may be divided among the winners. The number of players N depends on the size of the card deck. In general, N may be from two to ten.

The button 60 is a marker to mark a dealer position. The button may be any marker (e.g., a circular white disc) that is passed around the game table 20 in clockwise direction as seen by the players. The button 60 is placed in front of a player to signify that the player is the "dealer" in a given hand. Since most casinos provide the dealer 30 for deal cards, the "dealer" player does not actually deal the cards. The "dealer" player is merely used to mark the position for the dealing round. In a typical casino, the dealer 30 deals cards beginning with the player to the left of the button, and ending with the player who has the button in front of him. When the hand is over, either the dealer 30 or the player will move the button one spot in clockwise motion for the next hand.

The card deck 70 is a standard poker card deck having N ranks and four suits (i.e., club, diamond, heart, and spade) except that N is less than 13. When N=12, there is no rank of two, i.e., the 2-cards are not used and there are 48 cards. When N=11, there is no rank of two and three, i.e., the 2- and 3-cards are not used and there are 44 cards. When N=10, there are no rank of two, three, and four, i.e., the 2-, 3-, and 4-cards are not used and there are 40 cards, etc. Using a card deck having less than 13 ranks provides more action and excitement to the players because it increases the odds or probability of obtaining a high poker hand. Alternatively, a card deck having any number of ranks including 13 ranks (or a 52-card deck) may be used but the ranking of the hands is according to the probability of the poker hand regardless of whether the hand is a good hand (e.g., from one pair to royal flush) or a high card hand.

Figure 1B:
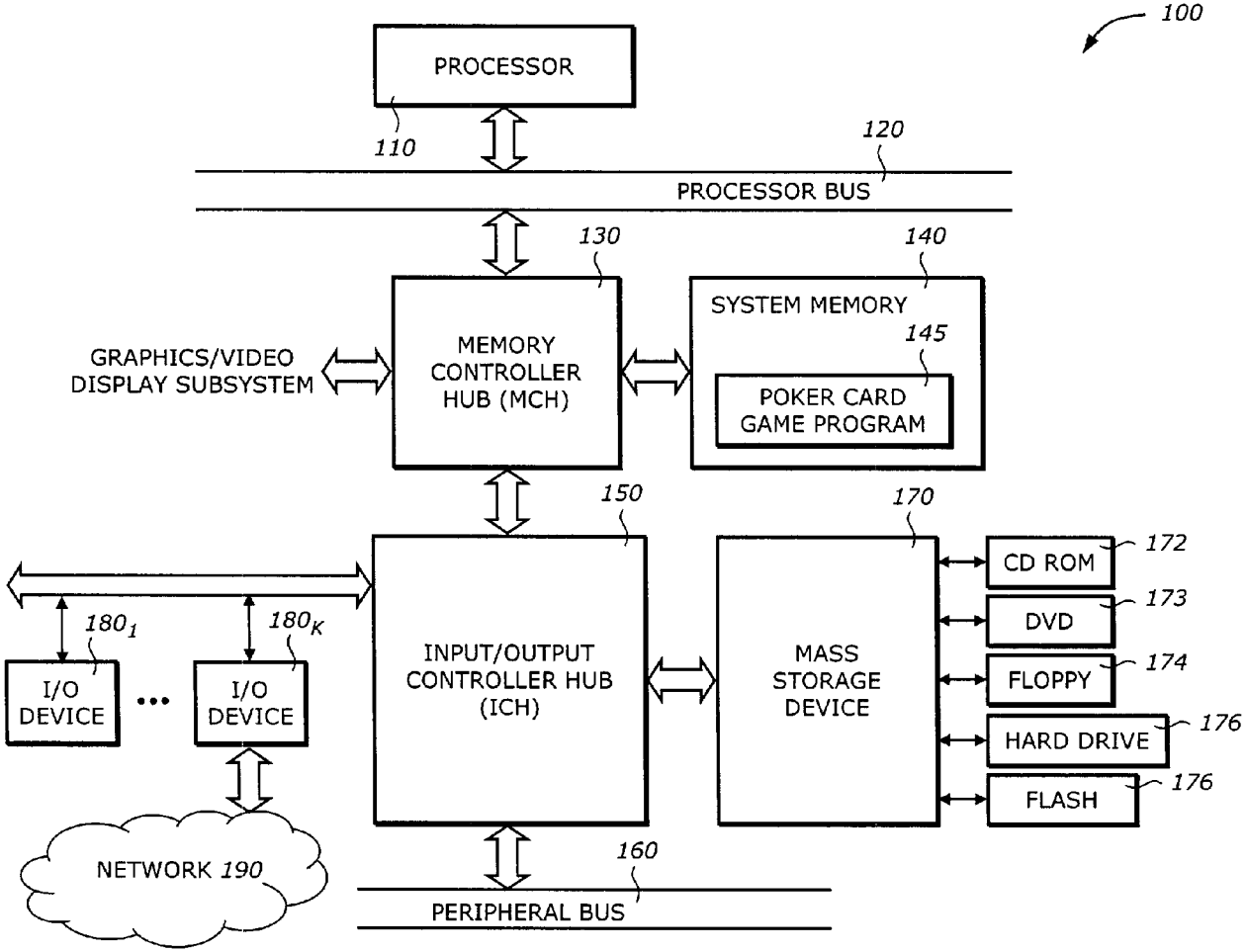
FIG. 1B is a diagram illustrating a processor system according to one embodiment of the invention.

FIG. 1B is a diagram illustrating a processor system 30 in which one embodiment of the invention can be practiced. The processor system 30 includes a processor 110, a processor bus 120, a memory control hub (MCH) 130, a subsystem memory 140, an input/output control hub (ICH) 150, a peripheral bus 160, a mass storage device 170, and input/output devices $\mathbf{180}_1$ to $\mathbf{180}_K$. Note that the server/client system 20 may include more or less elements than these elements.

The processor 110 represents a central processing unit of any type of architecture, such as embedded processors, mobile processors, micro-controllers, digital signal processors, superscalar computers, vector processors, single instruction multiple data (SIMD) computers, complex instruction set computers (CISC), reduced instruction set computers (RISC), very long instruction word (VLIW), or hybrid architecture.

The processor bus 120 provides interface signals to allow the processor 110 to communicate with other processors or devices, e.g., the MCH 130. The host bus 120 may support a uni-processor or multiprocessor configuration. The host bus 120 may be parallel, sequential, pipelined, asynchronous, synchronous, or any combination thereof.

The MCH 130 provides control and configuration of memory and input/output devices such as the system memory 140, the ICH 150. The MCH 130 may be integrated into a chipset that integrates multiple functionalities such as the isolated execution mode, host-to-peripheral bus interface, memory control. The MCH 130 interfaces to the peripheral bus 160. For clarity, not all the peripheral buses are shown. It is contemplated that the subsystem 40 may also include peripheral buses such as Peripheral Component Interconnect (PCI), accelerated graphics port (AGP), Industry Standard Architecture (ISA) bus, and Universal Serial Bus (USB), etc.

The system memory 140 stores system code and data. The system memory 140 is typically implemented with dynamic random access memory (DRAM) or static random access memory (SRAM). The system memory 140 may include program code or code segments implementing one embodiment of the invention. The system memory 140 includes a poker game program 145. Any one of the elements of the poker game program 145 may be implemented by hardware, software, firmware, microcode, or any combination thereof. The system memory 140 may also include other programs or data which are not shown, such as an operating system. The poker game program 145 contains program code that, when executed by the processor 110, causes the processor 110 to perform operations as described below.

The ICH 150 has a number of functionalities that are designed to support I/O functions. The ICH 150 may also be integrated into a chipset together or separate from the MCH 130 to perform I/O functions. The ICH 150 may include a number of interface and I/O functions such as PCI bus interface to interface to the peripheral bus 160, processor interface, interrupt controller, direct memory access (DMA) controller, power management logic, timer, system management bus (SMBus), universal serial bus (USB) interface, mass storage interface, low pin count (LPC) interface, etc.

The mass storage device 170 stores archive information such as code, programs, files, data, applications, and operating systems. The mass storage device 170 may include compact disk (CD) ROM 172, a digital video/versatile disc (DVD) 173, floppy drive 174, hard drive 176, flash memory 178, and any other magnetic or optic storage devices. The mass storage device 170 provides a mechanism to read machine-accessible media. The machine-accessible media may contain computer readable program code to perform tasks as described in the following.

The I/O devices $\mathbf{180}_1$ to $\mathbf{180}_K$ may include any I/O devices to perform I/O functions. Examples of I/O devices $\mathbf{180}_1$ to $\mathbf{180}_K$ include controller for input devices (e.g., keyboard, mouse, trackball, pointing device), media card (e.g., audio, video, graphics), network card, and any other peripheral controllers.

In particular, the network card $\mathbf{180}_K$ connects the system 100 to a network 190 or a server. Alternatively, the system 100 may be a server connected to the network 190. The network 190 may be any network. It may be a local area network (LAN), a wide area network (WAN), an intranet, or an Internet. In one embodiment, the network 190 is the Internet and the system 100 is a server providing on-line poker game. In the on-line poker game, the players have access to the Internet through any Internet Service Provides (ISPs). The players participate in the poker game remotely. The players may provide credit to play by paying the provider of the on-line poker game using credit cards or any other types of payment.

Elements of one embodiment of the invention may be implemented by hardware, firmware, software or any combination thereof. The term hardware generally refers to an element having a physical structure such as electronic, electromagnetic, optical, electro-optical, mechanical, electromechanical parts, etc. The term software generally refers to a logical structure, a method, a procedure, a program, a routine, a process, an algorithm, a formula, a function, an expression, etc. The term firmware generally refers to a logical structure, a method, a procedure, a program, a routine, a process, an algorithm, a formula, a function, an expression, etc that is implemented or embodied in a hardware structure (e.g., flash memory, ROM, EROM). Examples of firmware may include microcode, writable control store, micro-programmed structure. When implemented in software or firmware, the elements of an embodiment of the present invention are essentially the code segments to perform the necessary tasks. The software/firmware may include the actual code to carry out the operations described in one embodiment of the invention, or code that emulates or simulates the operations. The program or code segments can be stored in a processor or machine accessible medium or transmitted by a computer data signal embodied in a carrier wave, or a signal modulated by a carrier, over a transmission medium. The "processor readable or accessible medium" or "machine readable or accessible medium" may include any medium that can store, transmit, or transfer information. Examples of the processor readable or machine accessible medium include an electronic circuit, a semiconductor memory device, a read only memory (ROM), a flash memory, an erasable ROM (EROM), a floppy diskette, a compact disk (CD) ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc. The machine accessible medium may be embodied in an article of manufacture. The machine accessible medium may include data that, when accessed by a machine, cause the machine to perform the operations described in the following. The machine accessible medium may also include program code embedded therein. The program code may include machine readable code to perform the operations described in the following. The term "data" here refers to any type of information that is encoded for machine-readable purposes. Therefore, it may include program, code, data, file, etc.

All or part of an embodiment of the invention may be implemented by hardware, software, or firmware, or any combination thereof. The hardware, software, or firmware element may have several modules coupled to one another. A hardware module is coupled to another module by mechanical, electrical, optical, electromagnetic or any physical connections. A software module is coupled to another module by a function, procedure, method, subprogram, or subroutine call, a jump, a link, a parameter, variable, and argument passing, a function return, etc. A software module is coupled to another module to receive variables, parameters, arguments, pointers, etc. and/or to generate or pass results, updated variables, pointers, etc. A firmware module is coupled to another module by any combination of hardware and software coupling methods above. A hardware, software, or firmware module may be coupled to any one of another hardware, software, or firmware module. A module may also be a software driver or interface to interact with the operating system running on the platform. A module may also be a hardware driver to configure, set up, initialize, send and receive data to and from a hardware device. An apparatus may include any combination of hardware, software, and firmware modules.

One embodiment of the invention may be described as a process which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a program, a procedure, a method of manufacturing or fabrication, etc.

FIGS. 2 through 5 show a typical sequence of the game. In a casino room, the figures show the game table. In the on-line game, these figures represent the typical display of the game at each display screen of the remote players. For the on-line or video game, usually the private cards or the pocket cards are shown only to the player holding them, but shown face down on the table. For illustrative purposes, N=7 in these figures.

Figure 2:
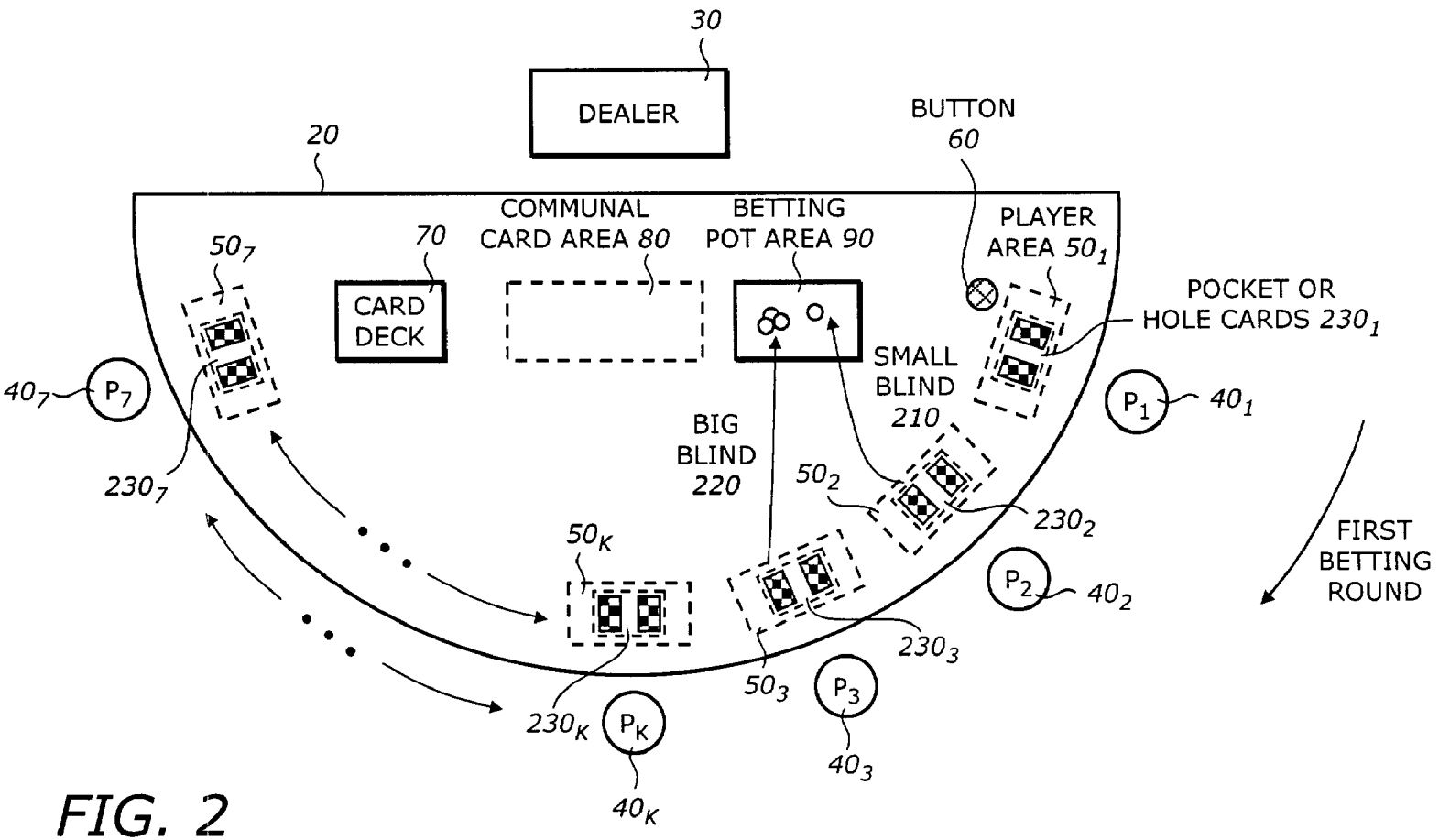
FIG. 2 is a diagram illustrating a first betting round according to one embodiment of the invention.

FIG. 2 is a diagram illustrating a first betting round according to one embodiment of the invention. The first betting round is referred to a pre-flop betting round. In the pre-flop betting round, blind bets are used to start the pot off.

A blind bet is a forced bet that is made by a player before he even sees his cards. It is a mandatory bet. There are two blinds, a small blind 210 and a big blind 220. The big blind 220 is equal to the fixed betting limit for the first round. For example, at a 3-6, the fixed betting amount for the first two rounds of betting is 3 dollars. Therefore, the size of the big blind 220 is 3 dollars. The size of the small blind 210 is typically half of the big blind 220. When the big blind 220 is an odd number like 3 dollars, the small blind 210 is either 1 or 2 dollars.

The player to the left of the dealer position (or the button position) places the small blind into the pot. The player to the left of the small blind 210 places the big blind 220 into the pot 90. The term "left" here refers to the next position in a clockwise direction. Both of these blind bets are mandatory, and are made before the cards are even dealt. They are forced bets, but they are live bets. The dealer then deals P number of pocket or hole cards $\mathbf{230}_k$, facing down or private to each player k and beginning to the left of the big blind 220. P may be any number less than 5 in a five-card poker game. Typically P=2 or 3. The players decide if they will see and call the amount of the big blind, see and raise, or fold. When it reaches the player at the small blind 210, he or she owes the difference between the two blind bets (since the big blind has put in more money than him or her), plus any raises that were made. When it reaches the player at the big blind 220, he or she owes for any raises that were made, and himself or herself has the option to raise, even if nobody raised into him or her. The dealer 30 typically presents this option to the player at the big blind 220 before proceeding with the game.

Figure 3:
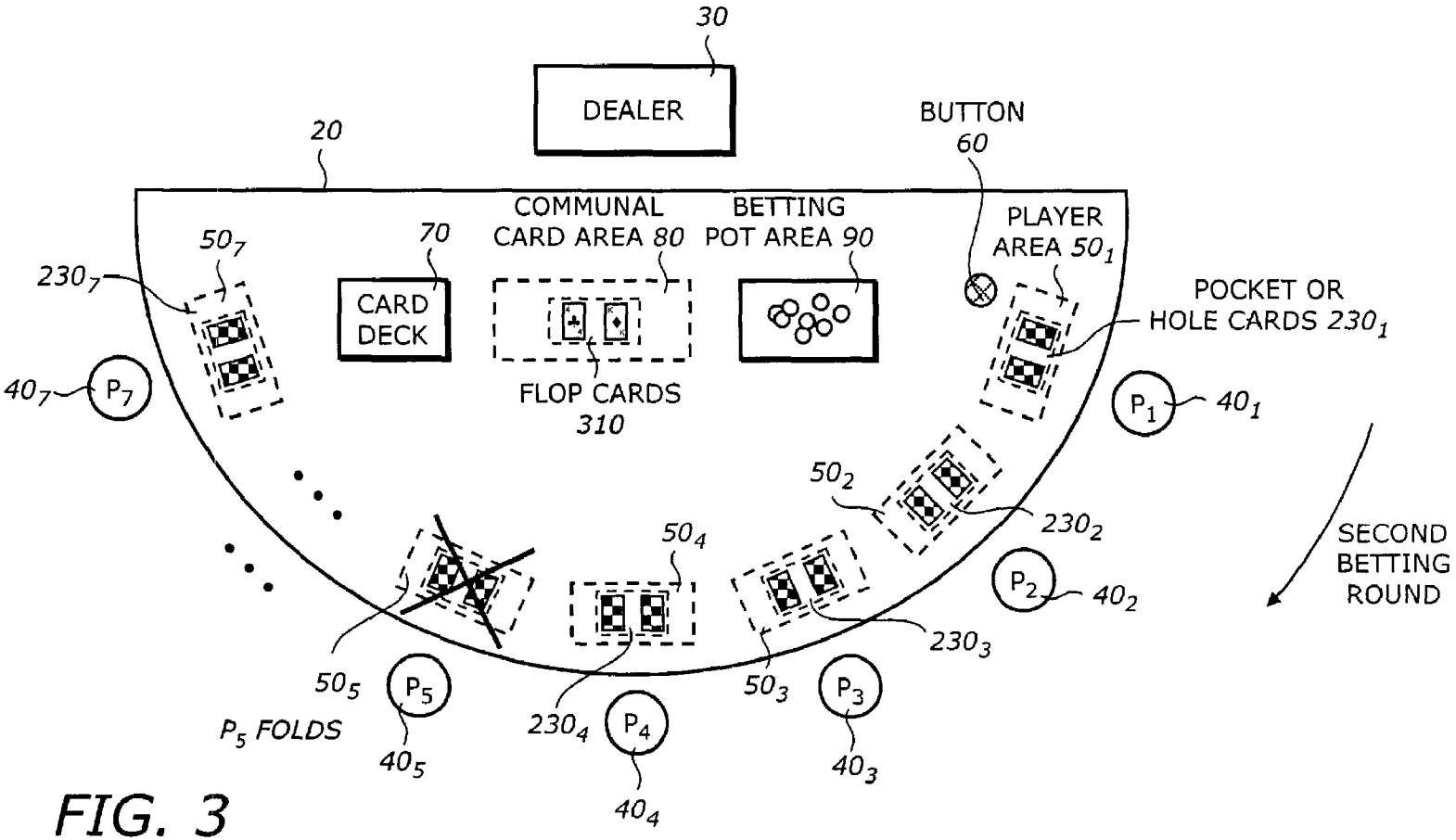
FIG. 3 is a diagram illustrating a second betting round according to one embodiment of the invention.

FIG. 3 is a diagram illustrating a second betting round according to one embodiment of the invention. The dealer 30 removes, discards, bumps, or burns the top card off the deck 70 and proceeds to deal F number of flop cards 310 face-up in the communal card area 80. F may be any number such that P+F is less than or equal 5. Typically, F=1, 2, or 3. In the following discussion, F=2. The two flop cards are seen by all the players. A player k uses these two flop cards 310 and the pocket cards $\mathbf{230}_k$ to determine his or her winning chance or chance to obtain a high ranking poker hand. The betting round is opened (or passed) by the player to the left of the dealer button 60, and moves clockwise around the table, the same as a regular betting round.

At a 3-6 table, the fixed betting amount on this round is still 3 dollars. Therefore, all bets or raises must be 3 dollars. A player who wishes to call a previous bet and raise puts 6 dollars into the pot. In such a game, it is not necessary to announce the amount of money being put in the pot because it is fixed. If a player is betting, it is 3 dollars. If he is raising, it is 6 dollars. If a player is calling 2 bets and raising, it is 9 dollars. In other words, it is always fixed. Typically, a player needs only announce his or her action, and the amount of money is assumed. In this example, the player $P_5$ selects the fold/discard option and withdraws from the game.

Figure 4:
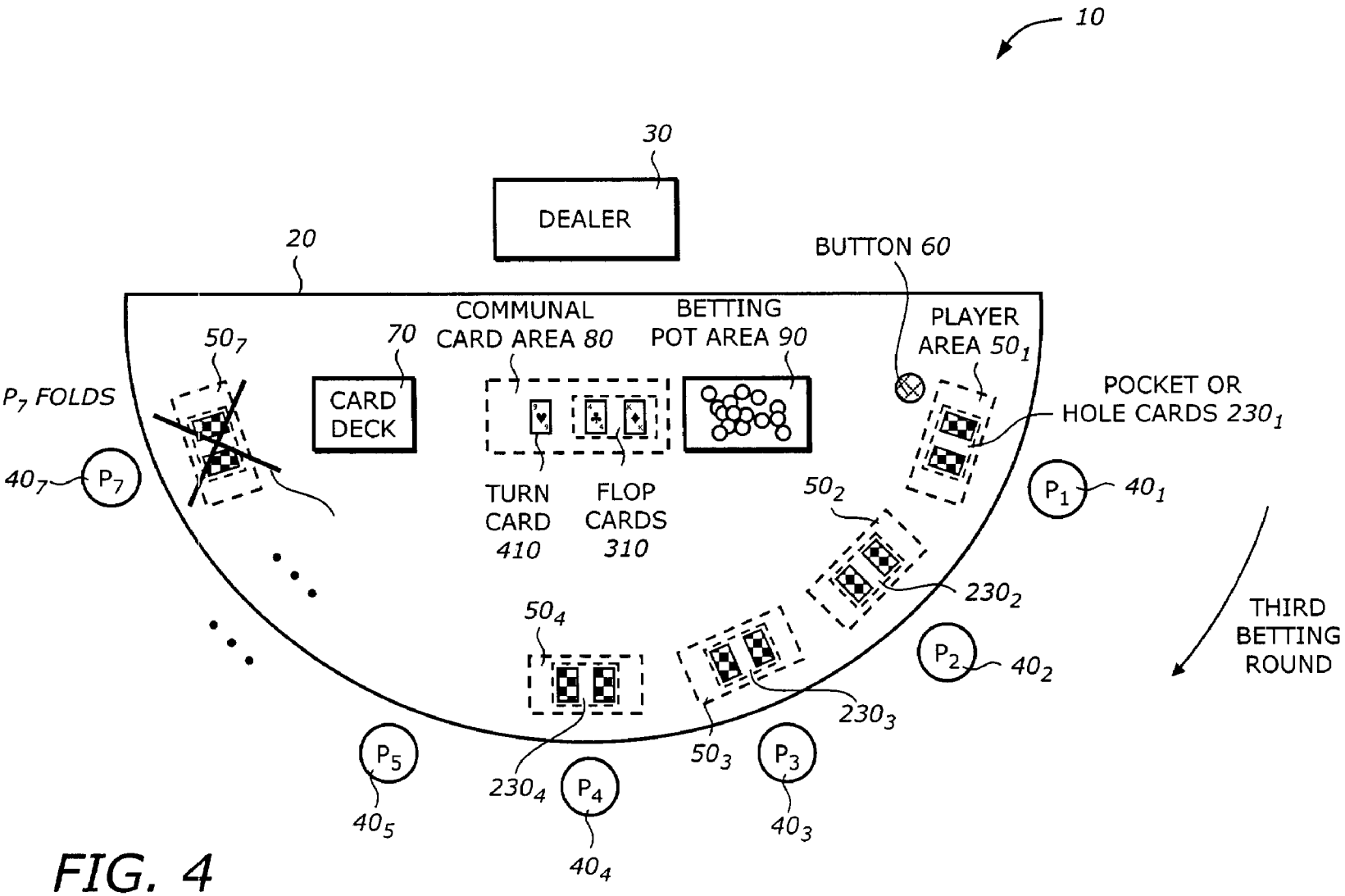
FIG. 4 is a diagram illustrating a third betting round according to one embodiment of the invention.

FIG. 4 is a diagram illustrating a third betting round according to one embodiment of the invention. The dealer 30 removes or burns another card off the top of the deck 70 and proceeds to deal T third card(s) or turn card(s) 410 face-up in the communal card area 80. T may be any number. Typically, T=1 or 2. In the following discussion, T=1. In this example, the player $P_7$ selects the fold/discard option and withdraws from the game. At a 3-6 table, the fixed betting amount on this round and the next one increases to 6 dollars. Bets and raises must be 6 dollars.

Figure 5:
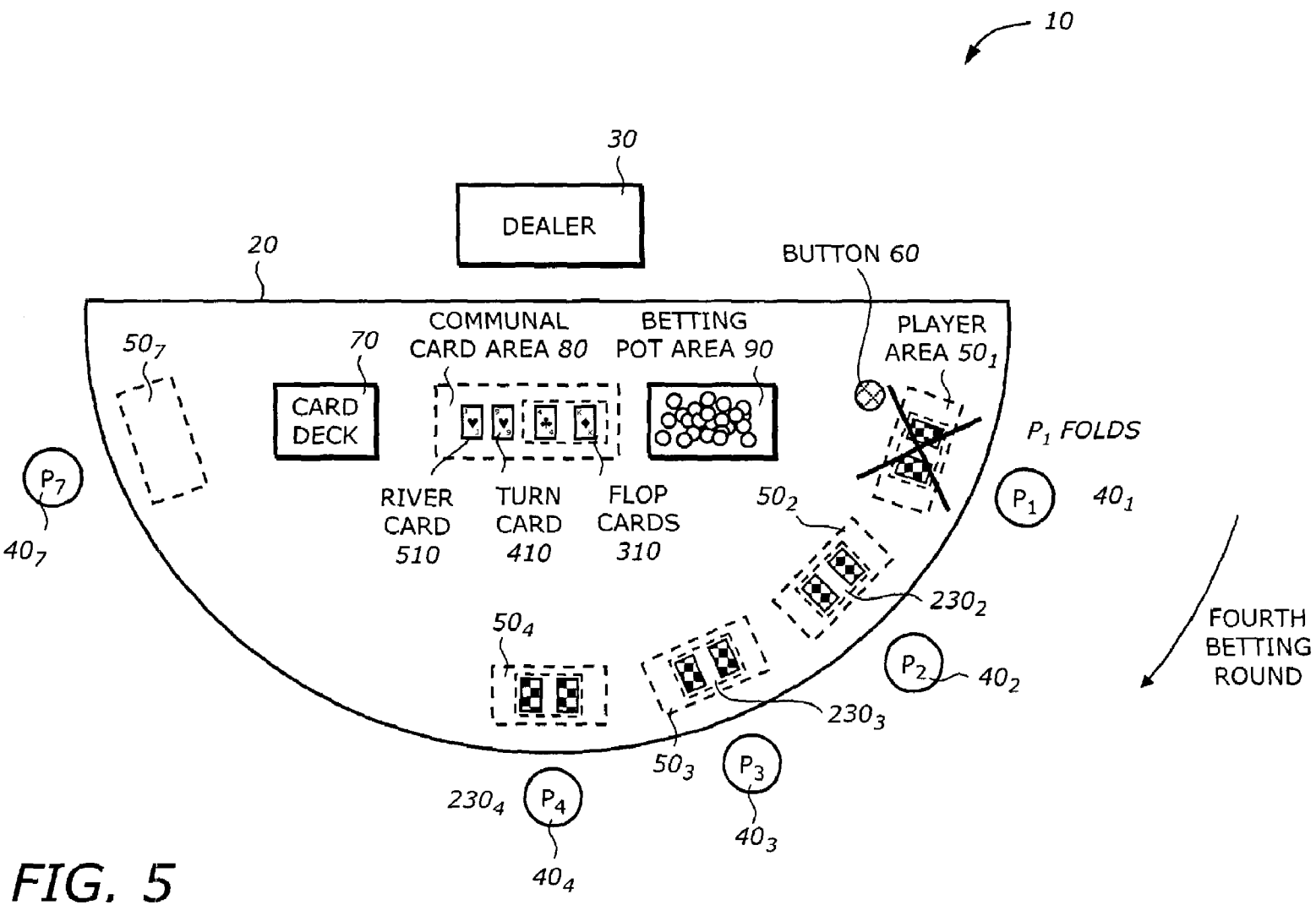
FIG. 5 is a diagram illustrating a fourth betting round according to one embodiment of the invention.

FIG. 5 is a diagram illustrating a fourth betting round according to one embodiment of the invention. The dealer 30 removes or burns another card off the top of the deck 70 and proceeds to deal R fourth card(s) or river card(s) 510 face-up in the communal card area 80. R may be any number such that P+F+T+R is between 5 to 8, or any reasonable number to allow the players option to form the best 5-card poker hand from any combinations of the pocket cards and the communal cards. In this example, the player $P_1$ selects the fold/discard option and withdraws from the game. As mentioned, the fixed betting amount on this round at a 3-6 table is 6 dollars.

Players still in the game reveal their hands to determine the winner. A player's hand is determined by combining the two pocket or hole cards 230*k* that were dealt to him or her with the four cards in the communal card area 80 to produce the best five-card poker hand. It can happen that the five cards on the board are better than any hand that includes a player's hole cards. In a rare case like this, the player is said to be "playing the board", meaning that the five cards in the center of the table is his or her five-card hand. The best he or she can do is tie with another player who is also playing the board.

Note that although the above discussion has four betting rounds, the card game can be played with more or less than four betting rounds. In addition, the number of cards dealt at each betting round may be any suitable number. Let B is the number of betting rounds, some examples of the combination of B and the number of cards dealt at each betting round are:

B=4:

P=2, F=2, T=1, and R=1.

P=3, F=2, T=1, and R=1

P=2, F=1, T=2, and R=1

P=2, F=1, T=2, and R=2

P=2, F=2, T=2, and R=1

B=3:

P=2, F=2, T=2

P=3, F=2, T=1

FIG. 6 is a diagram illustrating an order of ranking of the poker hands according to one embodiment of the invention.

The probability of a five card poker hand formed from a 52-deck card is given in tables 1, 2, 3, 4, 5, 6, and 7 according to the number of ranks N from N=13, 12, 11, 10, 9, 8, and 7, respectively. Note that for N=12, the lowest straight can be formed by Ace, three, four, five, and six. For N=11, the lowest straight can be formed by Ace, four, five, six and seven. For N=10, the lowest straight can be formed by Ace, five, six, seven and eight, and so on.

The probability of the hands can be used as a criterion to rank the hand. In one embodiment, the ranking may be performed in two groups: a good hand group and a high card group. A good hand group includes one-pair, two-pair, straight, three of a kind, flush, full house, and royal flush hands. The high card group includes ace high, king high, queen high, jack high, ten high, nine high, etc. In another embodiment, the ranking depends only on the probability regardless of whether the hand is a good hand or a high card hand.

Table 1 shows the probability of the poker hands using a 52-card deck. As seen, the full house hand ranks higher than the flush hand because its probability is less than the probability of the flush hand. Note that the probabilities of the full house and flush hands are not significantly different, being 0.00144 and 0.00196, respectively.

TABLE 1

| Total combinations | 2,598,960 | Probability |
|---|---|---|
| Royal flush | 4 | 0.000001539 |
| Straight flush | 36 | 0.000013852 |
| Four of a kind | 624 | 0.000240096 |
| Full house | 3,744 | 0.001440576 |
| Flush | 5,108 | 0.001965402 |
| Straight | 10,200 | 0.003924647 |
| Three of a kind | 54,912 | 0.021128451 |
| Two pair | 123,552 | 0.047539016 |
| Pair | 1,098,240 | 0.422569028 |
| Ace high | 502,860 | 0.193485086 |
| King high | 335,580 | 0.129120879 |
| Queen high | 213,180 | 0.082025118 |
| Jack high | 127,500 | 0.049058085 |
| Ten high | 70,380 | 0.027080063 |
| Nine high | 34,680 | 0.013343799 |
| Eight high | 14,280 | 0.005494505 |
| Seven high | 4,080 | 0.001569859 |

Table 2 shows the probability of the poker hands using a 48-card deck (N=12). As seen, the flush hand ranks higher than the full house hand because its probability is less than the probability of the full house hand. However, the difference between the two probabilities is insignificant. This card deck therefore does not provide good action because there are two good hands that have approximately the same probability.

TABLE 2

| Total combinations | 1,712,304 | Probability |
|---|---|---|
| Royal flush | 4 | 0.000002336 |
| Straight flush | 32 | 0.000018688 |
| Four of a kind | 528 | 0.000308356 |
| Full house | 3,168 | 0.001850139 |
| Flush | 3,132 | 0.001829114 |
| Straight | 9,180 | 0.005361198 |
| Three of a kind | 42,240 | 0.024668517 |
| Two pair | 95,040 | 0.055504163 |
| Pair | 760,320 | 0.444033302 |
| Ace high | 334,560 | 0.195385866 |
| King high | 213,180 | 0.124498921 |
| Queen high | 127,500 | 0.074461077 |
| Jack high | 70,380 | 0.041102515 |
| Ten high | 34,680 | 0.020253413 |
| Nine high | 14,280 | 0.008339641 |
| Eight high | 4,080 | 0.002382754 |

Table 3 shows the probability of the poker hands using a 44-card deck (N=11). As seen, the flush hand ranks higher than the full house hand because its probability is less than the probability of the full house hand. A poker game using this card deck provides more action than the previous two because the probabilities are higher.

TABLE 3

| Total combinations | 1,086,008 | Probability |
|---|---|---|
| Royal flush | 4 | 0.000003683 |
| Straight flush | 28 | 0.000025782 |
| Four of a kind | 440 | 0.000405154 |
| Full house | 2,640 | 0.002430921 |
| Flush | 1,816 | 0.001672179 |
| Straight | 8,160 | 0.007513757 |
| Three of a kind | 31,680 | 0.029171056 |
| Two pair | 71,280 | 0.065634876 |
| Pair | 506,880 | 0.466736893 |
| Ace high | 212,160 | 0.195357677 |

TABLE 3-continued

| Total combinations | 1,086,008 | Probability |
|---|---|---|
| King high | 127,500 | 0.117402450 |
| Queen high | 70,380 | 0.064806152 |
| Jack high | 34,680 | 0.031933466 |
| Ten high | 14,280 | 0.013149074 |
| Nine high | 4,080 | 0.003756878 |

Table 4 shows the probability of the poker hands using a 40-card deck (N=10). As seen, the flush hand ranks higher than the full house hand because its probability is less than the probability of the full house hand. A poker game using the 40-card deck provides more action than the previous three because the probabilities are higher. Note that the full house probability is 0.003282, which is significantly higher than the next higher rank flush hand whose probability is 0.001489. Comparing with the 52-card deck, the 40-card deck provides higher probabilities for hands of the same rank. For example, the royal flush has a probability 4 times more, the straight flush has 2.6 time more, the four of a kind 2.27 more, the flush 1.03 time more than the full house (which is of the same ranking), the full house 1.67 times more than the flush (which is of the same ranking), the straight 2.78 times more, the three of a kind 1.65 time more than the equivalent hands in the 52-card deck.

TABLE 4

| Total combinations | 658,008 | Probability |
|---|---|---|
| Royal flush | 4 | 0.000006079 |
| Straight flush | 24 | 0.000036474 |
| Four of a kind | 360 | 0.000547106 |
| Full house | 2,160 | 0.003282635 |
| Flush | 980 | 0.001489344 |
| Straight | 7,140 | 0.010850932 |
| Three of a kind | 23,040 | 0.035014772 |
| Two pair | 51,840 | 0.078783237 |
| Pair | 322,560 | 0.490206806 |
| Ace high | 126,480 | 0.192216508 |
| King high | 70,380 | 0.106959186 |
| Queen high | 34,680 | 0.052704526 |
| Jack high | 14,280 | 0.021701864 |
| Ten high | 4,080 | 0.006200533 |

Table 5 shows the probability of the poker hands using a 36-card deck (N=9). As seen, the flush hand ranks higher than the full house hand because its probability is less than the probability of the full house hand. A poker game using this card deck provides more action than the previous four because the probabilities are higher. However, as the number of cards is less than the previous four, the number of players may be limited.

TABLE 5

| Total combinations | 376,992 | Probability |
|---|---|---|
| Royal flush | 4 | 0.000010610 |
| Straight flush | 20 | 0.000053052 |
| Four of a kind | 288 | 0.000763942 |
| Full house | 1,728 | 0.004583652 |
| Flush | 480 | 0.001273237 |
| Straight | 6,120 | 0.016233766 |
| Three of a kind | 16,128 | 0.042780749 |
| Two pair | 36,288 | 0.096256684 |
| Pair | 193,536 | 0.513368984 |

TABLE 5-continued

| Total combinations | 376,992 | Probability |
|---|---|---|
| Ace high | 69,360 | 0.183982684 |
| King high | 34,680 | 0.091991342 |
| Queen high | 14,280 | 0.037878788 |
| Jack high | 4,080 | 0.010822511 |

Table 6 shows the probability of the poker hands using a 32-card deck (N=8). As seen, the flush hand ranks higher than the four of a kind and full house hands because its probability is less than the probabilities of the four of a kind and full house hands. However, the difference between the probabilities between the four of a kind and the flush hands is insignificant. In addition, the number of cards is only 32, limiting the number of players.

TABLE 6

| Total combinations | 201,376 | Probability |
|---|---|---|
| Royal flush | 4 | 0.000019863 |
| Straight flush | 16 | 0.000079453 |
| Four of a kind | 224 | 0.001112347 |
| Full house | 1,344 | 0.006674082 |
| Flush | 204 | 0.001013030 |
| Straight | 5,100 | 0.025325759 |
| Three of a kind | 10,752 | 0.053392659 |
| Two pair | 24,192 | 0.120133482 |
| Pair | 107,520 | 0.533926585 |
| Ace high | 33,660 | 0.167150008 |
| King high | 14,280 | 0.070912125 |
| Queen high | 4,080 | 0.020260607 |

Table 7 shows the probability of the poker hands using a 28-card deck (N=7). As seen, the flush hand ranks higher than the four of a kind and full house hands because its probability is less than the probabilities of the four of a kind and full house hands. However, the difference between the probabilities between the four of a kind and the flush hands is insignificant. In addition, the number of cards is only 28, limiting the number of players.

TABLE 7

| Total combinations | 98,280 | Probability |
|---|---|---|
| Royal flush | 4 | 0.000040700 |
| Straight flush | 12 | 0.000122100 |
| Four of a kind | 168 | 0.001709402 |
| Full house | 1,008 | 0.010256410 |
| Flush | 68 | 0.000691901 |
| Straight | 4,080 | 0.041514042 |
| Three of a kind | 6,720 | 0.068376068 |
| Two pair | 15,120 | 0.153846154 |
| Pair | 53,760 | 0.547008547 |
| Ace high | 13,260 | 0.134920635 |
| King high | 4,080 | 0.041514042 |

As shown in tables 1 through 7, the probabilities of the poker hands increase as the number of cards decreases. The game action and excitement tend to increase when the probabilities of occurrences of the poker hands are increased, especially when there is a sufficient number of players. In one embodiment, the card deck having 10 ranks with 40 cards seems to offer the best compromise between action and number of players. FIG. 6 shows the poker hands when a 40-card deck is used.

At the end of the game, a winner among the players is declared and paid according to an order of the ranking of the five-card poker hand using a combination of the pocket cards, the flop cards, the turn card, and the river card. The ranking is based on a probability of occurrence of the five-card poker hand. In one embodiment, the ranking also depends on whether the hand is a good hand or a high card hand. For good hands (i.e., from one pair to royal flush), the smaller the probability, the higher the rank of the hand. For high card hands (i.e., hands having cards of different ranks and suits other than straight), the higher the probability, the higher the rank of the hand.

In another embodiment, the ranking depends only on the probability of the hand, regardless of whether the hand is a good hand or a high card hand. In this embodiment, N may be any number, including 13 (or 52 cards). For example, when a 52-card deck, is used, the ranking may be in the order of highest to lowest as follows: royal flush, straight flush, four of a kind, full house, seven high, flush, straight, eight high, nine high, three of a kind, ten high, two-pair, Jack high, Queen high, King high, Ace high, and one-pair, in accordance to the individual probability as shown in Table 1. In this embodiment, since the ranking is based on the probability only, players receiving low cards at the beginning may still want to stay in the game.

In one embodiment, a jackpot may be put aside to give the players who have good hands (e.g., full house ace, flush, straight flush). The player who receives the jackpot may be one who loses the game or wins the game. The one who wins may receive a smaller percentage of the jackpot than the one who loses. This jackpot may be taken from the pot and may be accumulated over games if nobody wins the jackpot. Additional conditions may be imposed to qualify for the jackpot. For example, the P pocket cards are to be part of the 5-card hand that qualifies for the jackpot.

Figure 7:
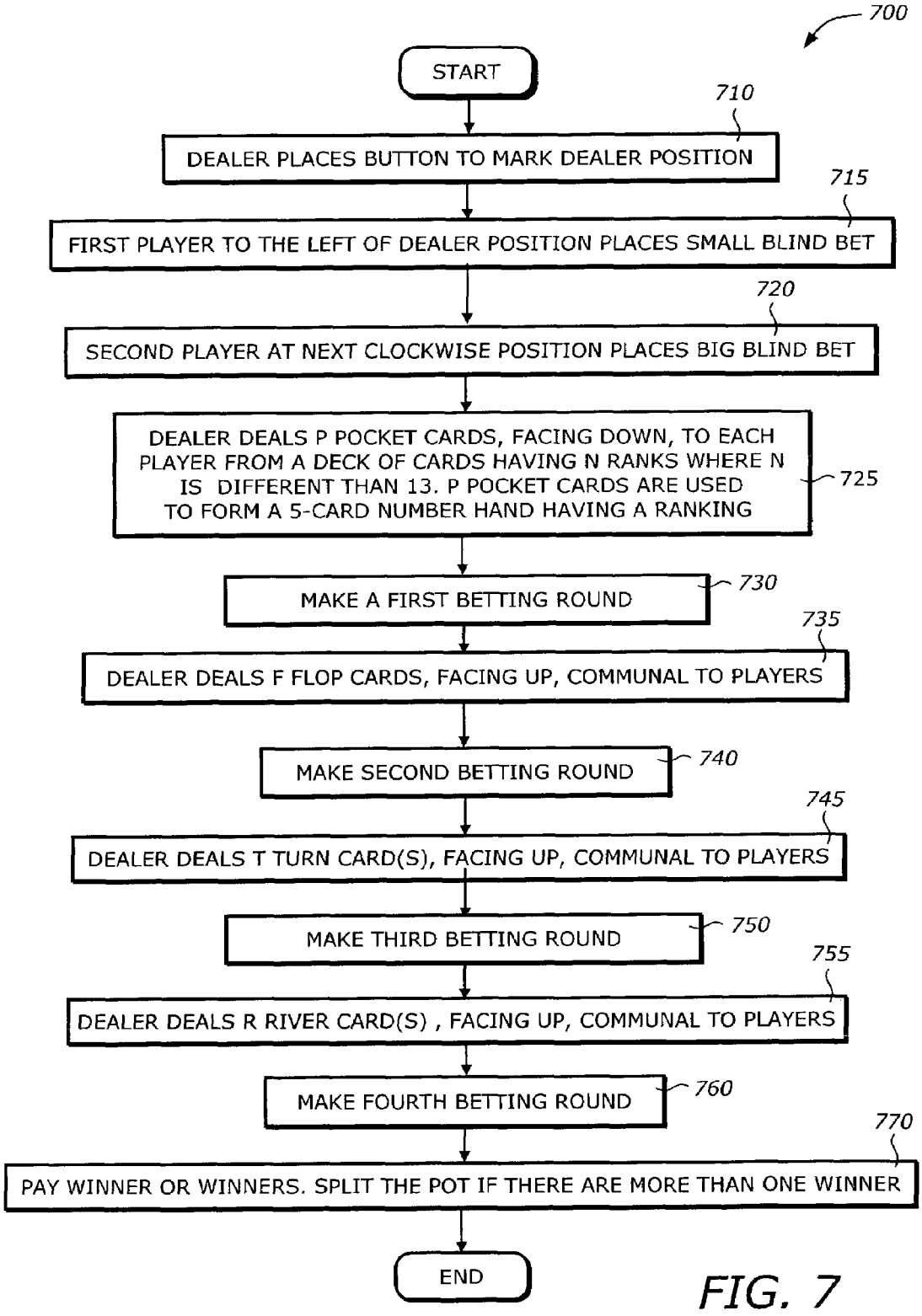
FIG. 7 is a flowchart illustrating a process to play a card game according to one embodiment of the invention.

FIG. 7 is a flowchart illustrating a process 700 to play a card game according to one embodiment of the invention.

Upon START, the dealer places a button to mark a dealer position (Block 710). Then, the player to the left of the dealer position places a small blind bet to the pot (Block 715). Next, the player at the next clockwise position, i.e., to the left of the small blind player, places a big blind bet to the pot (Block 720). The, the dealer deals P pocket or hole cards, facing down, to each of the players (Block 725) from a deck of cards having N ranks where N is different than 13. The N pocket cards are used by each of the players to form a five-card poker hand having a ranking. The N pocket cards are reviewed by each of the players, and not revealed to others.

Then, the process 700 makes a first betting round (730). Next, the dealer deals F flop cards, facing up, and places them at the communal area (Block 735). Before dealing the F flop cards, the dealer typically discards, removes, or bumps a card on top of the deck. The F flop cards are communal to all the active players who are still in the game. Then, the process 700 makes a second betting round (Block 740).

Next, the dealer deals T turn card(s), facing up, and places it at the communal area (Block 745). Before dealing the T turn card(s), the dealer typically discards, removes, or bumps a card on top of the deck. The T turn card(s) is communal to all the active players. Then, the process 700 makes a third betting round (Block 750). Next, the dealer deals R river card(s), facing up, and places it/them at the communal area (Block 755). Before dealing the R river card(s), the dealer typically discards, removes, or bumps a card on top of the deck Then, the process 700 makes a fourth betting round (Block 760). Next, the process 700 pays the winner or winners according to an order of the ranking of the five-card poker hand using a combination of the P pocket cards, the F flop cards, the T turn card(s), and the R river card(s) (Block 770). In case of ties, the pot is split among the winners. The process 700 is then terminated.

Figure 8:
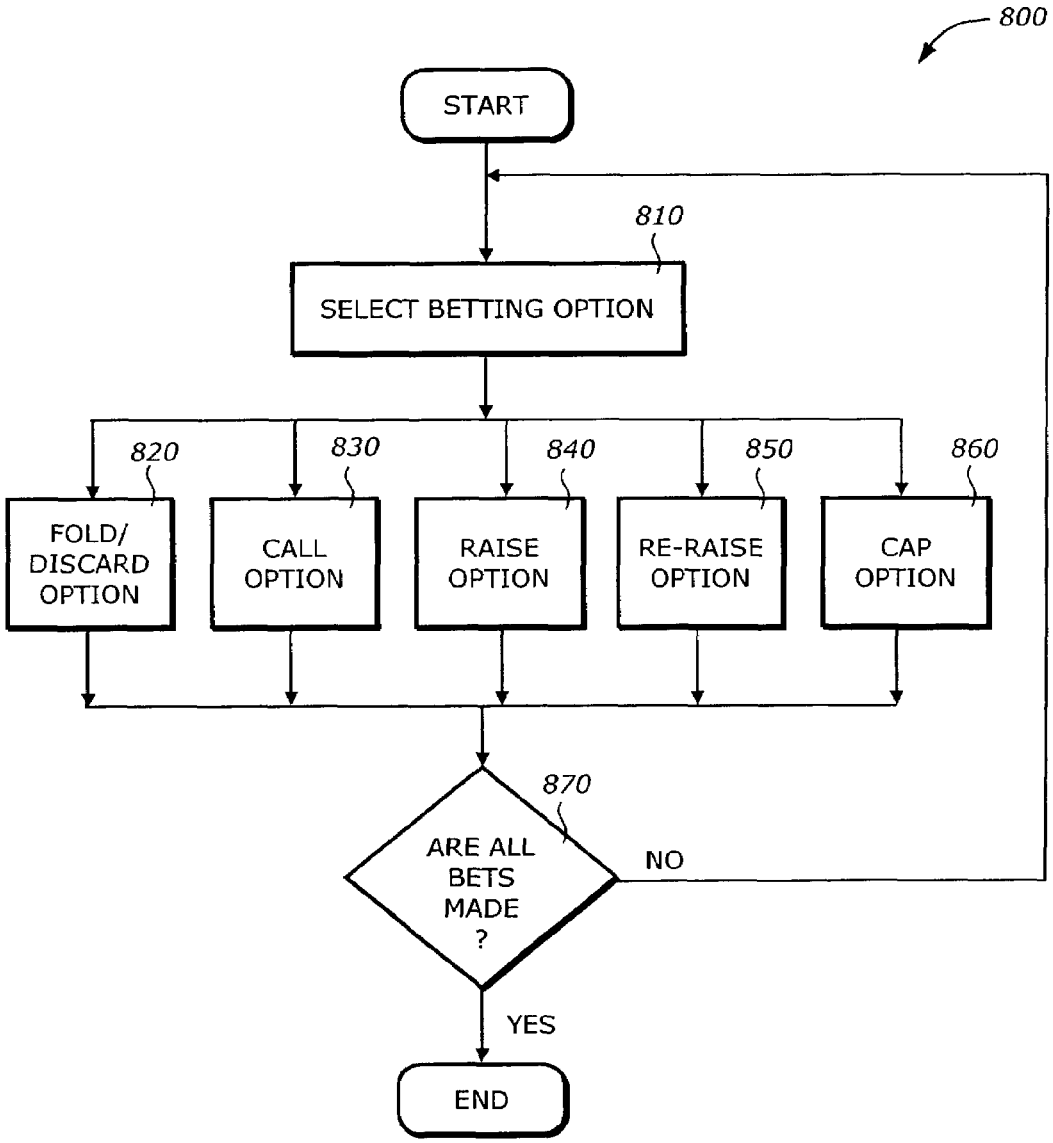
FIG. 8 is a flowchart illustrating a process to make a betting round according to another embodiment of the invention.

FIG. 8 is a flowchart illustrating a process 800 to make a betting round according to another embodiment of the invention. The process 800 is equivalent to the Blocks 730, 740, and 750 shown in FIG. 7.

Upon START, a player selects a betting option (Block 810). The player typically determines his or her chance of winning or obtaining a good poker hand using any combination of the pocket cards and the cards in the communal area. The player may select a fold or discard option (Block 820) to withdraw from the game. The player may select a call option (Block 830) to call a bet or accept the call or bet set by another player. The user may select a raise option (Block 940) to raise the bet called or set by another player or by himself or herself. The user may select a re-raise option (Block 850) to raise again a bet that was raised earlier. The user may select a cap option (Block 860) to cap the maximum amount of bet allowed in the betting round.

Then, the process 800 determines if all bets have been made (Block 870). If not, the process 800 returns to Block 810. Otherwise, the process 800 is terminated.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting.

What is claimed is:

1. A method comprising:

dealing P pocket cards to each of a plurality of players from a deck of cards having N ranks and four suits, N being different than 13, the P pocket cards being used by the each of the players to form a five-card poker hand, providing a plurality of predetermined poker hands, all of the plurality of predetermined poker hands having different rankings according to a probability of occurrence, the probability of occurrence being determined based on N, wherein a flush hand, not including a straight flush hand or a royal flush hand, being ranked higher than a full house hand;

making a first betting round among the plurality of players, the first betting round contributing to a pot;

dealing F flop cards seen by the plurality of players, the F flop cards being communal to the players; and making a second betting round among the players, the second betting round contributing to the pot.

2. The method of claim 1 further comprising:

marking a dealer position among the players;

placing a first blind bet by a first player on a first side of the dealer position; and placing a second blind bet by a second player at a second side of the first player.

3. The method of claim 2 wherein making the first betting round comprises:

betting by one of the first player, the second player, and a third player, the third player being positioned next to the second player.

4. The method of claim 3 wherein betting by one of the first player, the second player, and the third player comprises:

selecting a betting option from a discarding option, a calling option, a raising option, a re-raising option, and a capping option, the calling, raising, re-raising, and capping options being based on one of the first and second blind bets.

5. The method of claim 2 wherein making the second betting round comprises:

betting by one of the first player, the second player, and a third player, the third player being positioned next to the second player.

6. The method of claim 5 wherein betting by one of the first player, the second player, and the third player comprises:

selecting a betting option from a discarding option, a calling option, a raising option, a re-raising option, and a capping option, the calling, raising, re-raising, and capping options being based on one of the first and second blind bets.

7. The method of claim 1 further comprising:

dealing at least one turn card seen by the players, the at least one turn card being communal to the players; and making a third betting round, the third betting round contributing to the pot.

8. The method of claim 7 wherein making the third betting round comprises:

betting by one of the first player, the second player, and a third player, the third player being positioned next to the second player.

9. The method of claim 8 wherein betting by one of the first player, the second player, and the third player comprises:

selecting a betting option from a discarding option, a calling option, a raising option, a re-raising option, and a capping option, the calling, raising, re-raising, and capping options being based on one of the first and second blind bets.

10. The method of claim 7 further comprising:

dealing at least one river card seen by the players, the at least one river card being communal to the players; and making a fourth betting round, the fourth betting round contributing to the pot.

11. The method of claim 10 wherein making the fourth betting round comprises:

betting by one of the first player, the second player, and a third player, the third player being positioned next to the second player.

12. The method of claim 11 wherein betting by one of the first player, the second player, and the third player comprises:

selecting a betting option from a discarding option, a calling option, a raising option, a re-raising option, and a capping option, the calling, raising, re-raising, and capping options being based on one of the first and second blind bets.

13. The method of claim 12 further comprising:

paying a winner among the players according to an order of the ranking of the five-card poker hand using a combination of the P pocket cards, the F flop cards, the at least one turn card, and the at least one river card.

14. The method of claim 13 wherein the probability of occurrence depends on N.

15. The method of claim 1 wherein an order of the ranking from highest to lowest includes a royal flush hand, a straight flush hand, a four of a kind hand, a flush hand, a full house hand, a straight hand, a three of a kind hand, a two pair hand, a one pair hand, and a high card hand.

16. The method of claim 1 wherein an order of the ranking from highest to lowest includes a royal flush hand, a straight flush hand, a flush hand, a four of a kind hand, a full house hand, a straight hand, a three of a kind hand, a two pair hand, a one pair hand, and a high card hand.

17. The method of claim 1 wherein an order of the ranking from highest to lowest when N=12 includes a royal flush hand, a straight flush hand, a four of a kind hand, a flush hand, a full house hand, an eight high hand, a straight hand, a nine high hand, a ten high hand, a three of a kind hand, a Jack high hand, a two pair hand, a Queen high hand, a King high hand, an Ace high hand, and a one pair hand.

18. The method of claim 1 wherein an order of the ranking from highest to lowest when N=11 includes a royal flush hand, a straight flush hand, a four of a kind hand, a flush hand, a full house hand, a nine high hand, a straight hand, a ten high hand, a three of a kind hand, a Jack high hand, a Queen high hand, a two pair hand, a King high hand, an Ace high hand, and a one pair hand.

19. The method of claim 1 wherein an order of the ranking from highest to lowest when N=10 includes a royal flush hand, a straight flush hand, a four of a kind hand, a flush hand, a full house hand, a ten high hand, a straight hand, a Jack high hand, a three of a kind hand, a Queen high hand, a two pair hand, a King high hand, an Ace high hand, and a one pair hand.

20. The method of claim 1 wherein an order of the ranking from highest to lowest when N=9 includes a royal flush hand, a straight flush hand, a four of a kind hand, a flush hand, a full house hand, a Jack high hand, a straight hand, a Queen high hand, a three of a kind hand, a King high hand, a two pair hand, an Ace high hand, and a one pair hand.

21. The method of claim 1 wherein an order of the ranking from highest to lowest when N=8 includes a royal flush hand, a straight flush hand, a flush hand, a four of a kind hand, a full house hand, a Queen high hand, a straight hand, a three of a kind hand, a King high hand, a two pair hand, an Ace high hand, and a one pair hand.

22. The method of claim 1 wherein an order of the ranking from highest to lowest when N=7 includes a royal flush hand, a straight flush hand, a flush hand, a four of a kind hand, a full house hand, a King high hand, a straight hand, a three of a kind hand, an Ace high hand, a two pair hand, and a one pair hand, the King high hand and the straight hand being equal in rank.

23. The method of claim 1 wherein an order of the ranking from highest to lowest includes a good hand group and a high card group, the good hand group ranking higher than the high card group, wherein the ranking in the good hand group is based on the probability of occurrence in a reverse order than in the high card group.

* * * * *